United States Patent [19]

Spencer, Jr.

[11] Patent Number: 4,547,407

[45] Date of Patent: Oct. 15, 1985

[54] ELECTROLESS METAL COATINGS INCORPORATING PARTICULATE MATTER OF VARIED NOMINAL SIZES

[75] Inventor: Robert A. Spencer, Jr., Wilmington, N.C.

[73] Assignee: Surface Technology, Inc., Princeton, N.J.

[21] Appl. No.: 540,303

[22] Filed: Oct. 11, 1983

Related U.S. Application Data

[60] Continuation of Ser. No. 406,548, Aug. 9, 1982, abandoned, which is a continuation-in-part of Ser. No. 280,830, Jun. 30, 1981, abandoned, which is a division of Ser. No. 201,305, Oct. 27, 1980, abandoned.

[51] Int. Cl.[4] ..... C23C 3/02

[52] U.S. Cl. ..... 427/367; 427/368; 427/443.1; 427/383.1

[58] Field of Search ..... 427/443.1 C, 367, 368, 427/383.1

[56] References Cited

U.S. PATENT DOCUMENTS

| | | | |
|---|---|---|---|
| Re. 29,285 | 6/1977 | Christini | 427/443.1 C |
| 2,643,221 | 6/1953 | Brenner et al. | 204/438 |
| 3,562,000 | 2/1971 | Parker | 427/443.1 C |
| 3,617,363 | 11/1971 | Metzger | 427/443.1 C |
| 3,753,667 | 8/1973 | Metzger et al. | 428/634 |
| 3,936,577 | 2/1976 | Christini et al. | 428/936 |
| 4,193,253 | 3/1980 | Herbert et al. | 57/58.89 |
| 4,195,470 | 4/1980 | Storhahn | 57/337 |

FOREIGN PATENT DOCUMENTS

| | | | |
|---|---|---|---|
| 1621206 | 6/1971 | Fed. Rep. of Germany . | |
| 1041753 | 9/1966 | United Kingdom | 427/443.1 C |
| 2056884 | 3/1981 | United Kingdom | 427/443.1 |

OTHER PUBLICATIONS

Hubbell, F. N., "Chemically Deposited Composites–A New Generation of Electroless Coatings", *Plating*, p. 58, (12/78).

Odekerken, J. M., "Use of Codeposited Non-Conducting Materials" *Electroplating and Metal Finishing*, p. 2, (1/64).

Safina, F. K. et al., "Composite Coatings Based on Chemically Reduced Nickel", translated *Zashchita Metallov*, 14, No. 4, p. 504, (1978).

Properties and Applications of Composite Diamond Coatings, "*Proceedings Diamond Partner in Productivity*", E. I. DuPont de Nemours & Co., p. 121, (1974).

"What You Should Know About Diamonizing" Electrocoatings, Morgan, California (no publication date).

Nickel-Boron Plus Diamonds Yields Wear Resistant Parts, *Material Engineering*, p. 55, (3/74).

DuPont Diamond Characteristics Performance Product Grades, pp. 1-3 (no publication date).

Microabrasives Corp., Westfield, Mass., p. 1, "Microgrit Powder Analysis", (1980).

Lowenheim, F. A., *Modern Electroplating*, John Wiley & Sons, pp. 720-723, (1974).

"What You Should Know About Nye-Carb", Electrocoatings, Moraga, Calif., pp. 1-4, (1975).

Sharp, W. F., *Prop. and Applications of Composites Diamond Coatings*, Presented 8th Plansee-Seminar in Realte/Tirol, (5/30/74).

"Diamonizing Process Composite Coating", New Release Electrocoating Inc., Moraga, Calif. (4/73).

Feldstein et al., "The State of the Art in Electroless Composite Plating", The First AES Electroless Plating Symposium, Mar. 23-24, 1982, St. Louis, Mo.

*Primary Examiner*—John D. Smith

*Attorney, Agent, or Firm*—Nathan Feldstein

[57] ABSTRACT

Disclosed are processes and articles for the preparation of composite electroless coatings which comprise a metal and/or metal alloy, plus particulate matter, the latter having at least two distinct nominal sizes.

25 Claims, No Drawings

ELECTROLESS METAL COATINGS INCORPORATING PARTICULATE MATTER OF VARIED NOMINAL SIZES

REFERENCE TO PRIOR APPLICATIONS

This application is a continuation of co-pending application Ser. No. 406,548 filed Aug. 9, 1982 now abandoned which is a continuation-in-part of copending application Ser. No. 280,830 filed June 30, 1981 now abandoned which is a divisional application of application Ser. No. 201,305 filed Oct. 27, 1980, now abandoned.

BACKGROUND OF THE INVENTION

Composite electroless coatings are a new generation of composite which can be derived via electroless plating techniques. The following patents and article reflect the state of the art, the techniques which are used, as well as those particulate matter which may be incorporated within the electroless plating matrix: U.S. Pat. Nos. 3,617,363; 3,674,447; 3,753,667; U.S. Pat. No. Re. 29,285; R. Barras et al, "Electroless Nickel Coatings - Diamond Containing", Electroless Nickel Conference, Cincinnati, Oh., Nov., 1979. These patents and publication are included herein by reference.

Though electroless plating may be applied to a wide variety of substrates, the coating of metallic substrates is of great technological interest for achieving any of several properties on the initial substrates (e.g., corrosion protection, wear resistance, frictional properties, etc.). Plating may be carried forth on non-conductor and semiconductor type substrates as well. Though the mechanism of composite electroless plating is not fully understood, it is believed that the insoluble particulate matter suspended within the electroless plating composition is entrapped and bound during the electroless plating process build-up. For an effective entrapment, the insoluble particle must attach itself to the surface and permit the conventional electroless plating process to proceed without interruption of the plating process.

It is therefore recognized, since the particulate matter does not appear to participate in the actual (basic) mechanism (see (1)Lukes, Plating, 51, 969 (1964); (2) N. Feldstein et al, J. Electrochem. Soc., 118, 869 (1971); (3) G. Salvago et al, Plating, 59, 665 (1972) ) of the conventional electroless plating but rather is entrapped, that it is therefore essential that there be a high probability for the particulate matter to "stick" to the surface and result in fruitful entrapment rather than contacting the surface and falling off into the bulk solution. It is also recognized that the electroless metal or alloy matrix provides "cement" for the entrapment of the particulate matter. Moreover, it is undesirable for the particles to become autocatalytic; hence, the electroless plating bath used must be stabilized and kept clean.

In reviewing the prior art, the following observations are noted.

(1) In U.S. Pat. Nos. 3,753,667 and 3,562,000 the use of specific particulate matter has been demonstrated along with the suggestion of mixture of particles of a different chemical nature.

(2) Hubbell, in a review article, Plating and Surface Finishing, Dec. 1978, pp. 58–62, has pointed out the general range of which particulate matter can be deposited. Similarly, Safina et al, in Zashchita Metallov, Vol. 14, No. 4, pp. 504–506, July/August 1978, have shown that various particles can be codeposited along with electroless metal deposition; however, in each case only a single nominal size is employed though each size contains a distribution of particle sizes.

(3) In British Pat. No. 1,041,753 composite electroless plating of selected particulate matter is shown (e.g., PVC and $Al_2O_3$) along with mixtures of particles of either the same chemical nature or varied chemical nature. However, the U.K. patent stipulates that in the case of admixture of two distinct nominal sizes, the size ratio of the smallest size be no more than one tenth of the larger size particle used. In the U.K. patent the examples for admixture of particles show ratios which are greater than 1:10 (small to large).

(4) Sharp, in an article "Properties and Applications of Composite Diamond Coating", p. 121, (1974) has pointed out the importance of particle size. He has noted that a 3-micron diamond is used more frequently as a compromise for a low surface roughness requirement. This compromise is made at the expense of wear, as is demonstrated in great detail in U.S. Pat. No. Re. 29,285.

(5) The problem of creating a smooth, friendly, composite coating has been noted in Machine Design, Nov. 24, 1977 by D. R. Dreger.

In any event, some of the problems associated with composite electroless plating, particularly as applied to surface roughness, have been recognized but the present findings and solution have not been available heretofore, especially in permitting the use of large particles (e.g., 6 micron or greater) while yet attaining a lower surface roughness with greater ease.

None of the above art provides any appreciation of the present invention in which two nominal sizes of particulate matter are combined, thereby resulting in a smoother surface (as-plated) as well as requiring less energy in attaining a lower level of surface finish (smoothing). Though there are a wide variety of metals and alloys that can be electrolessly plated, commercial applications are primarily focused upon the metals selected from the group of nickel, cobalt and copper. Depending upon the nature of the reducing agent used (e.g., hypophosphite vs. dimethyamine borane), other alloying constituents may be present (e.g., phosphorus vs. boron). For descriptions of the state of the art in electroless plating see "Modern Electroplating", 3rd Edition, John Wiley & Sons, F. A. Lowenheim, Editor, Chapter 31.

In general, in the present invention, particles in the size range of 0.5 to 100 microns may be contemplated, though commercial practices are more limited to 0.5 to 10 microns in size. It has generally been the practice to select the desired nominal particle size with a narrow particle size distribution. In most applications, 15 to 30% by volume has been used, though it is possible, particularly with higher temperature and/or high bath load concentration, to achieve particle loading within the deposit approaching 50%.

In the case of diamond particulate matter, especially diamond of a polycrystalline nature (manufactured by an explosion process), preferred particles may be selected in the range of 1 to 9 microns in size. The actual nominal size depends upon the ultimate application.

The hardness of Ni-P type deposits can reach approximately 69 Rockwell C units with heat treatment, as is well known in the art. In the case of nickel-boron type deposits, hardness values of 1050 $VHN_{50}$ can be reached with heat treatment. The inclusion of particulate matter inherently increses the roughness of the coating. In certain applications (e.g., texturing of yarn utilizing friction texturing discs), a decrease in final surface roughness is most necessary to insure a minimum of damage to the yarn. The final degree of smoothness or surface finish for usage is becoming increasingly important with the ongoing improvements and increased speed of commercial machines.

It is thus the prevailing practice to smooth (e.g., by brushing) the outer surface of the composite coating prior to usage. However, smoothing is a tedious and expensive process, especially for composites containing wear-resistant particles, particularly in a hard matrix. Accordingly, it is thus highly desirable to provide coatings which would preserve their wear-resistance properties while requiring a minimum amount of brushing time (or any other mechanical smoothing technique, e.g., blasting, honing, tumbling, etc.).

SUMMARY OF THE INVENTION

A process and articles for electroless plating incorporating particulate matter are described. The process and article(s) thereof comprise at least one distinct metallic layer comprising particulate matter having particles selected from at least two distinct nominal sizes which nominal sizes differ by a few microns and their ratio (large nominal size to small nominal size) is less than 10:1.

DETAILED DESCRIPTION OF THE INVENTION

Though there is a wide variety of articles and products to which the present invention is useful, specific articles are those having a cylindrical or a disc-type geometry.

The articles (e.g., textile machinery parts) which will be used or affected by this process are of the general types known in the textile industry as friction texturing discs, spinning rolls (open end and others), and rotors. Generally, these parts have circular, bell shaped, cylindrical or multi-cylindrical geometries. They are primarily used in a spinning or rotary fashion with the directional movement of the part about an axis which is perpendicular to the plane of rotation.

Specifically, friction texturing discs used to impart a false twist have a multi-cylindrical geometry (Textured Yarn Technology/Volume 2, Stretch Yarn Machines, Monsanto Co. 1967, Edited by G. D. Wilkinson, STI, p. 16) with the outside circumference, or that which actively contacts the yarn, slightly rounded or convex. Contact of the yarn is made partly perpendicular to the part's circumference, and parallel to the axis of rotation.

Spinning rolls are of a cylindrical geometry in which yarn contacts the outside circumference in a parallel or unidirectional fashion, or perpendicular to the axis of rotation. The outside or active circumference of this part usually contains pins or teeth which actually perform the necessary functions.

Rotors (see U.S. Pat. No. 3,439,487) are bell shaped articles in which the yarn contacts the open end of the piece in a direction which is parallel to the axis of rotation and leaves in an opposite direction.

Many of these materials are of aluminum, aluminum alloy, or plastics, due to their light weight, cost, and relative ease of shaping. Other metallic substrates which may be used with the present invention, aside from aluminum alloys, may be carbon steel alloy and tooled steel, 400 series stainless steel, high speed steel, 300 series stainless steel, brass, copper and its alloys, nickel and its alloys, and combinations thereof.

For achieving the maximum hardness (e.g., 69 $R_c$) for typical nickel phosphorus coating, heat treatment at a temperature of about 750° F. should be carried forth. This heat treatment step, aside from providing improved adhesion of the metallic layers to the substrate, provides the well known matrix hardening for nickel phosphorus or nickel boron type alloys.

Surface roughness of composite coatings is generally dependent upon various factors: particle size; concentration of particles; thickness of the coating. In general it has been observed that as the particle size increases, so does the surface roughness. Greater concentrations of the specific particle further tend to increase the surface roughness for the resulting composite coating.

At the same time it has been observed that the wear resistance properties for composite coatings are dependent on the size of the particle used. Specifically, composites having large size particles included within the coating provide a greater wear resistance capability in comparison to composites having smaller size particles. Accordingly, the attainment of good wear resistant coatings suggests the use of larger nominal size particles which dictates the necessity for greater roughness.

The present method provides economical ways by which the wear resistant properties for composite electroless coatings are maintained (e.g., the use of large particles), while at the same time simple and economical means for attainment of a desired surface smoothness for usage is achieved. It should be noted that the foregoing examples are limited and that the scope of the invention encompasses variations in the nature of the electroless plating bath used as well as variations in the nominal size and/or nature of particulate matter used in said composite coatings, as well as the substrate to be coated.

Though the concept of the present invention is demonstrated using diamond and silicon carbide as the insoluble particulate matter, the adaptation of the present concept to other insoluble particles may be applied, e.g., wear resistant particles, plastic, alloys and metals.

The present invention is based upon the admixing of two nominal sizes of particulate matter. Within each nominal size there exists a distribution of particles; generally the majority of said particles are approximately close in size to the specified nominal size.

In the present invention the beneficial effect(s) take place whenever the difference in nominal sizes between the large nominal size particle to the small nominal size particle is a few micron units. As seen from the examples representing the present invention, in general the difference in nominal size is a few microns.

Regardless, however, of the nature of the particles used, the combination of two distinct nominal sizes of particulate matter having a ratio of less than 10:1 (large nominal size to small nominal size) falls within the spirit of this invention.

The following examples are provided to illustrate the concept of the present invention.

EXAMPLE 1

An electroless nickel bath of Enplate 415 (product of Enthone, Inc., New Haven, CT) was prepared as specified by the manufacturer. To this bath was added a slurry to make 20 g per liter of 6μ FG Du Pont diamond (DD) polycrystalline and 8 g per liter of 3μ FG Du Pont diamond (DD) polycrystalline, with agitation. Bath temperature was raised to 88° C.

An aluminum friction texturing disc was used as substrate with standard aluminum pretreatment procedure well known in the art. Thereafter, the treated substrate was immersed into the composite plating bath with mild rotation. Plating was carried forth for about 1.0 hour with a resultant coating thickness of about 20 microns. Thereafter, the plated article was heat treated at 500° F. for 1 hour to provide better adhesion and the hardening of the matrix. Destructive testing of the plated disc revealed an overall diamond concentration of 37% by volume.

The plated and heat treated disc was brushed using a commercial brushing machine. After a test period (standard brushing time) of 15 minutes a roughness of 13 AA was obtained. Using a coating with only 6μ diamond at about the same volume concentration in the coating would require unreasonably long brushing time (several hours, e.g., 5 hours) to yield 13 AA finish These results reveal the unexpected observation that the admixture of diamond sizes within the coated part resulted in a disc that obtained a surface finish much smoother than obtainable with a 6μ alone, yet no significant reduction in diamond concentration resulted as a consequence of the codeposition of the 3μ diamond.

Analysis of the distribution of diamond within the coating was representative of the diamond concentration resulting from the bath make-up. The size frequency distribution within the plating bath was similar to the nominal size frequency distribution within the coating.

EXAMPLE 2

Plating bath make-up and conditions were the same as in Example 1. However, the bath comprised of 15 g per liter of 3μ FG Du Pont diamond (DD) polycrystalline along with 5 g per liter of 1½μ FG Du Pont diamond polycrystalline. Mild agitation was applied during the plating in order to suspend the diamonds.

After all treatments (as in Example 1) results yielded a roughness of 8 AA surface finish. By contrast, a coating with only 3μ particles provided , at best, a 13 AA surface finish.

EXAMPLE 3

Plating bath make-up and conditions and subsequent procedures were the same as in Example 1 with the exception that 15 g per liter of both 3μ and 6μ FG Du Pont diamond (DD) polycrystalline were used.

The surface roughness after brushing was 9 AA units. This surface roughness could not be attained with the 6μ alone with a reasonable amount of brushing time.

EXAMPLE 4

Contrary to the above examples in which diamond was employed, silicon carbide was employed as the particulate matter in the present example. The electroless deposition process and plating bath was the same as in Example 1. The silicon carbide were nominal sizes of 5μ and 2μ, as well as the admixture of 5μ and 2μ together. Following deposition and heat treatment (which is an optional step), smoothing by brushing was undertaken for different periods. Concentration was 20 g per liter for the 5μ and 8 g per liter for the 2μ.

The resulting surface roughnesses attained are summarized as function of time.

| Brushing time (sec.) | Roughness (AA) 2μ SiC only | (2μ + 5μ) SiC | 5μ SiC only |
|---|---|---|---|
| NONE | 10.7 | 21.6 | 26.1 |
| 3 | 7.0 | 13.1 | 15.1 |
| 12 | 6.4 | 11.7 | 13.3 |
| 30 | 6.2 | 11.1 | 12.4 |

From the above results the following observations are drawn and conclusions noted.

1. As-plated the admixture of the mixed particle sizes of the present invention yields a lower surface roughness in comparison to the surface roughness attained with the large particles alone.

2. The plateau in surface roughness attainable with continuous brushing time for the admixture vs. the large particles alone is the same, for all practical purposes.

3. Though the plateau in surface roughness with continued brushing time is the same for the admixture of particles as for the large particles alone, the attainment of the plateau level requires a shorter brushing time or less expenditure of energy.

While I do not wish to be bound by theory, it appears that the plateau level in the admixture is dominated by the large particles, which also accounts for the ultimate wear resistance for the composite.

EXAMPLE 5

In this example, polycrystalline diamond having nominal sizes of 6μ and 0.5μ were used alone and in an admixture. Due to the large surface area, especially for small particles (0.5μ), the overall concentration (e.g., loading in the bath) for the particles was lowered by a factor of 2 from the values of Example 1 (10 g per liter and 4 g per liter, respectively).

The resulting surface roughnesses attained are summarized as function of time.

| Brushing time (sec.) | Roughness (AA) 0.5μ only | (0.5μ + 6μ) | 6μ only |
|---|---|---|---|
| NONE | 6.0 | 26.6 | 26.5 |
| 15 | 5.6 | 18.4 | 18.5 |
| 30 | 5.6 | 14.8 | 14.4 |
| 60 | 6.2 | 13.9 | 13.7 |
| 120 | 6.4 | 13.7 | 13.4 |
| 240 | 6.6 | 13.7 | 13.6 |

From these results the following conclusions are drawn.

1. The beneficial results of the present invention appear to disappear in an admixture of particles in which the large particle is about 10 fold or more in comparison to the small size.

2. The profile of roughness vs. brushing time pattern for the large particle alone is virtually identical to that for the admixture of particles. Accordingly, it appears that utilizing the admixture according to the stipulation of the Odekerken British Pat. No. '753 results in an inoperative range.

The following observations are noted which may account for the mechanism taking place in the utilization of two distinct nominal sizes of particulate matters.

It was noted that these coatings "as-plated" provided with smoother coating relative to the same coating with the large particles alone in similar concentration range.

This represents a decrease in surface roughness of approximately 15% to 20%.

In addition, as noted from the above results, the coating comprising the admixture of two distinct nominal sizes clearly reveals that smoother coating can be achieved with application of minimal amounts of energy as represented in the brushing operation.

While I do not wish to be bound by theory, it is possible that the unexpected results noted for the combination of two distinct nominal sizes of particles may be accounted for by any of the following factors operating singly or in combination.

It is possible that, since the brushing operation tends to (preferentially) level the particulate matter sticking out of the interface coating, in the case of the admixture of large and small particles a partial leveling of the large particles, with the smaller particles remaining embedded around the large particles, is sufficient to lead to the ultimately desired leveling or roughness level. In the case of large particles alone, scanning electron microscopy pictures generally reveal particles embedded within the matrix, each isolated from neighboring particles. Hence, to achieve the same diminished roughness as with the combination of large and small particles (roughnesses between the high point and the low point, which is the matrix) more energy will be required in the brushing operation. One may argue that the finer particles embedded in the uniform distribution around the large particles in effect raise the base line for the apparent roughness measurements.

It is also believed that the particulate size distribution resultant in the coating, being similar to the particulate size distribution existing in the plating bath as a function of the bath make-up, indicates that the plating mechanism for overall particulate matter deposition is not related to particle size, but more so related to random statistical frequency of entrapment. Additionally, comparing photomicrographs of the surface of the coatings comprised of a mixture of discrete particulate nominal sizes indicates that the spacing of the larger particulate size in the mixture has been impacted by the addition of the smaller size when compared to a coating of the larger size alone.

In summarizing the present findings, it is noted that each nominal size of particulate matter has its own particle size distribution with a majority (peak distribution) generally at, or close to, the nominal size assigned by the manufacturer. Moreover, the quantity for the small nominal size relative to the large nominal size is significant; only when the differences for these sizes are a few microns and in a ratio (large to small) of less than 10:1 is the beneficial effect(s) attained. Though the present invention has employed the admixture of two nominal sizes, three or more nominal sizes can be admixed; such combinations fall within the spirit of the invention.

I claim:

1. In a process of the electroless metallization of a substrate comprising contacting said substrate with an electroless plating bath to deposit a metallic layer on the surface of said substrate, said plating bath comprising a metal salt, an electroless reducing agent thereof, and a quantity of finely divided insoluble particulate matter, said particulate matter being suspended in said plating bath, and thereafter smoothing the surface of said metallic layer thereby decreasing the surface roughness of said metallic layer, the improvement comprising utilizing as the particulate matter an admixture of one chemical substance having at least two distinct sizes of particulate matter, at least one of said sizes being relatively larger than at least one of said other sizes, such that the amount of energy required to smooth the surface of said metallic layer is reduced in comparison with the amount of energy normally required to smooth surfaces formed by the same general process, but using primarily only the larger size of particulate matter and furthermore wherein the relative ratio for the large size to the small size is less than 10:1.

2. The process according to claim 1 wherein said particulate matter is wear resistant particles.

3. The process according to claim 1 wherein said particulate matter is diamond.

4. The process according to claim 1 wherein said particulate matter is diamond of a polycrystalline type.

5. The process according to claim 1 wherein said electroless plating bath is nickel.

6. The process according to claim 1 wherein said particulate matter is in the size range of 0.1 to 100 microns.

7. The process according to claim 1 wherein said reducing agent is hypophosphite.

8. The process according to claim 1 wherein the particulate matter is diamond of a monocrystalline type.

9. The process according to claim 1 further containing the step of heat treating for sufficient time to heat harden the resultant coating.

10. The process according to claim 1 wherein said electroless plating bath is operating above room temperature.

11. The process according to claim 1 wherein said particulate matter is in the size range of 1 to 10 microns.

12. The process according to claim 1 wherein said particulate matter is 9 and 3 microns in size.

13. The process according to claim 1 wherein said particulate matter is 6 and 3 microns in size.

14. The process according to claim 1 wherein said particulate matter is 6 and $1\frac{1}{2}$ microns in size.

15. The process according to claim 1 wherein said particulate matter is silicon carbide.

16. The process according to claim 1 wherein said substrate is an aluminum alloy.

17. The process according to claim 1 wherein said particulate matter is distributed from about 5% to about 50% by volume in the resulting composite coating.

18. The process according to claim 1 further containing the step of heat treating the resulting coating in the temperature range of 100° C. to 600° C.

19. The process according to claim 1 wherein said substrate is applicable for textile application.

20. A method for reducing the surface roughness of an electroless composite coating which is produced by contacting a substrate with an electroless plating bath comprising a metal salt, an electroless reducing agent thereof, and a quantity of finely divided insoluble particulate matter and wherein said particulate matter is suspended within said plating bath and wherein said particulate matter is the admixture of one chemical substance having at least two distinct nominal sizes at least one of said nominal sizes being relatively larger than the other nominal size to deposite onto the surface of said substrate a metallic layer in which said particulate matter is distributed, and containing said distinct particle sizes, said composite coating having a surface roughness lower than the surface roughness of coatings containing only particulate matter of said larger nominal size and wherein the relative ratio for the larger nominal size to the small nominal size is less than 10:1.

21. The method according to claim 20 wherein said particulate matter is wear resistant particles.

22. The method according to claim 20 wherein said prticulate matter is diamond.

23. The method according to claim 20 wherein said particulate matter is silicon carbide.

24. The method according to claim 20 wherein said particulate matter is in the size range of 0.1 to 100 microns.

25. The method according to claim 20 wherein said particulate matter is distributed from about 5% to about 50% by volume in the resulting composite coating.

* * * * *